US006691541B2

(12) United States Patent
Noéet al.

(10) Patent No.: US 6,691,541 B2
(45) Date of Patent: Feb. 17, 2004

(54) STRETCH LEVELER FOR STEEL AND OTHER METAL STRIP

(75) Inventors: Andreas Noé, Kerken (DE); Rolf Noé, Mühlheim/Ruhr (DE)

(73) Assignee: BWG Bergwerk- und Walzwerk -Maschinenbau GmbH, Duisburg (DE)

( * ) Notice: Subject to any disclaimer, the term of this patent is extended or adjusted under 35 U.S.C. 154(b) by 0 days.

(21) Appl. No.: 10/107,536

(22) Filed: Mar. 26, 2002

(65) Prior Publication Data

US 2002/0157440 A1 Oct. 31, 2002

(30) Foreign Application Priority Data

Mar. 26, 2001 (DE) ..... 101 14 883

(51) Int. Cl.[7] ..... B21D 1/05
(52) U.S. Cl. ..... 72/7.4; 72/160; 72/205
(58) Field of Search ..... 72/160, 164, 205, 72/7.4

(56) References Cited

U.S. PATENT DOCUMENTS

| | | | | | |
|---|---|---|---|---|---|
| 2,370,895 | A | * | 3/1945 | Wean | 72/205 |
| 2,526,296 | A | * | 10/1950 | Stone | 72/205 |
| 5,341,664 | A | * | 8/1994 | Noe et al. | 72/205 |
| 5,666,836 | A | * | 9/1997 | Bonnefont et al. | 72/205 |
| 5,704,237 | A | * | 1/1998 | Noe et al. | 72/205 |
| 6,109,084 | A | * | 8/2000 | Hutzenlaub et al. | 72/205 |

FOREIGN PATENT DOCUMENTS

| | | |
|---|---|---|
| DE | 36 36 707 | 5/1988 |
| DE | 39 12 676 | 10/1990 |
| DE | 196 45 599 | 5/1998 |

* cited by examiner

*Primary Examiner*—Daniel C. Crane
(74) *Attorney, Agent, or Firm*—Herbert Dubno

(57) ABSTRACT

A stretch leveling apparatus having at least two stretching zones and wherein the lengths of the first and second stretching zones are each at least 0.5 times the maximum strip width.

13 Claims, 6 Drawing Sheets

STRETCH LEVELER FOR STEEL AND OTHER METAL STRIP

FIELD OF THE INVENTION

Our present invention relates to a stretch leveler for steel and other metal strip. More particularly, the stretch leveler of the invention is intended for metal strip having a thickness range of substantially 0.1 to 4 mm between a minimum thickness and a maximum thickness and a strip width range between a minimum width and a maximum width which can be 600 to 1850 mm typically.

BACKGROUND OF THE INVENTION

In general, stretch levelers have in the past been provided with a multiplicity of bridles which have alternately acted as braking roll sets and traction roll sets and between which respective stretching or stretch leveling zones have been formed. As a practical matter, at least two stretching or leveling zones have been provided in such systems.

Because of the subdivision of the leveling effect into two (or more) leveling zones, planarity can be improved with respect to single zone stretch levelers since in an earlier stretching zone the strip width is elastically reduced and in a subsequent leveling zone a more uniform tension distribution can be provided across the width of the strip so that the resulting strip will have greater planarity.

In the prestretching zone the strip tension can be raised practically to the yield limit $R_{P0.2}$ so that in combination with the bending effect determined by the final diameter of the tensioning drum or drums, there is a slight elastoplastic prestretch. As a consequence any deviation from planarity is partly removed as early as the prestretching zone. In such earlier systems it is theoretically also conceivable to raise the strip tension above the $R_{P0.2}$ value or to the $R_{P0.2}$ value in the prestretching zone.

There are stretch leveling systems known as well in which between the brake roll set and a traction roll set, a further roll pair can be provided to engage the strip. In that case, between each of those roll sets and the additional roll pair, there are formed respective stretching zones. A plastic deformation of the strip, however, appears to occur only in the region of the additional roll pair. For a satisfactory leveling action, however, the plastic stretching of the strip must be distributed between the roll sets and the additional roll pair (compare DE 39 12 676 C2).

In another system (DE 196 45 599) stretching regions are provided with a more complex roll arrangement between the brake roll set and the traction roll set.

Finally, as to the art, a stretch-bending system with three stretch bending rolls is known from DE 36 36 707 C2 in which the strip is bent alternately in opposite directions and a central stretch bend roll must be located between two other rolls which alternately are undershot and overshot by the strip.

OBJECTS OF THE INVENTION

It is the principal object of the present invention to provide a stretch leveling apparatus which is of simplified construction and which can reliably and with good and effective results impart planarity to steel and other metal strip.

Another object of the invention is to provide an apparatus which overcomes drawbacks of earlier systems and which can in a simple way ensure good planarity results for the stretch leveling of steel and other metal strip.

SUMMARY OF THE INVENTION

These objects and others which will become apparent hereinafter are attained, in accordance with the invention in an apparatus which comprises:

- a brake roll set having a plurality of brake rolls around which a traveling metal workpiece strip passes for exerting a drag upon the traveling metal workpiece strip;
- a traction roll set spaced from the brake roll set and having a plurality of traction rolls around which the traveling metal workpiece strip passes for exerting traction upon the traveling metal workpiece strip; and
- a driven roll engaging the traveling metal workpiece strip between the brake roll set and the traction roll set and defining a first leveling stretching zone between the brake roll set and the driven roll and a second leveling stretching zone between the driven roll and the traction roll set such that each of the zones has a length which is at least 0.5 times the maximum strip width.

According to a feature of the invention lengths of the first and second stretch leveling zones are each a maximum of ten times the maximum strip width. In a preferred embodiment the length of the first zone and the length of the second zone are each one to two times the maximum strip width. The diameters of all of the rolls described should be at least 1,000 times the maximum strip width.

Preferably the last roll of the tracking set and the first of the traction set and the driven roll have concave/convex contours which are adjustable. The adjustment can be effected zonewise over the width of the strip. At least one of the zones can be associated with a linear motor which influences the strip tension distribution across the width of the strip. The bending direction of the driven roll can be opposite that of the first roll of the traction set and the residual longitudinal curvature (coil set) or transverse curvature (bowing) in the strip can be corrected by adjustment to the ratio of the degree of stretch in the two zones.

According to a feature of the invention, the transverse curvature or bowing can be measured with an in-line sensor on a real-time or on-line basis and the measurement can be used as a parameter for a closed-control circuit for correction of the curvature.

Ahead of, in, or downstream of the leveling zone the planarity of the strip can be measured on an on-line basis and the measurement used as a parameter for planarity control of the stretch stages.

The strip can be slung around the driven roller by at most 180° and preferably at most 90°. The lengths of the first and second zones can be variable and adjusted to optimal lengths for the given strip thicknesses.

According to the invention, based upon theoretical calculations utilizing a dynamic finite element model, it has been found surprisingly that the lengths of the stretching zones mentioned above constitute an important criterium for the uniformity of the residual stress distribution across the strip width and thus the degree of planarity. The longitudinal tension stresses are constant across the width of the strip following leveling. Residual stress upon relief of the load can be zero and the strip ideally planar.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
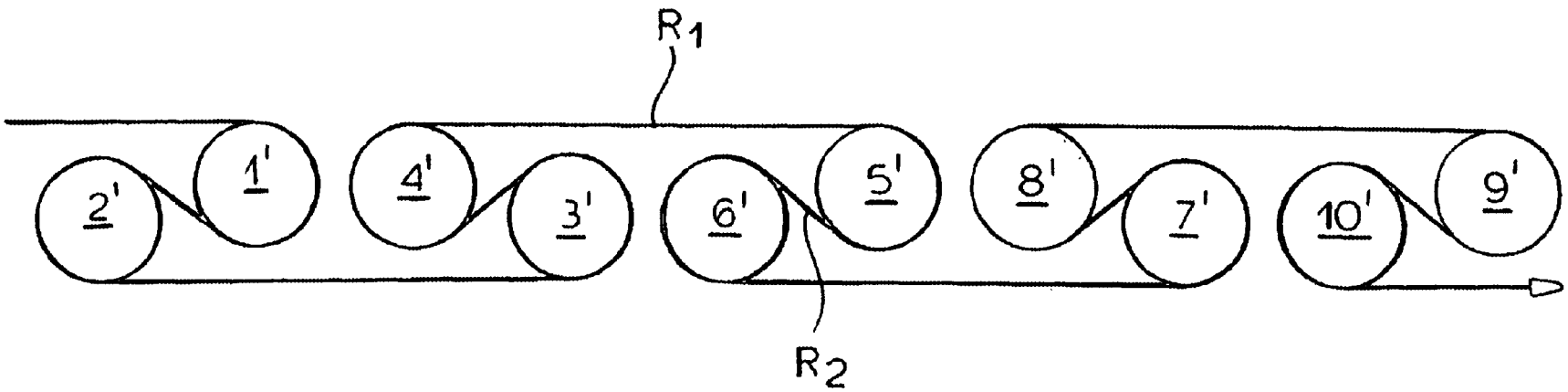
FIG. 1 PRIOR ART
FIG. 1 is a diagram showing a stretch leveler of prior art construction.

As can be seen from FIG. 1, a typical stretch leveler for steel or other metal strip can comprise five sets of bridles, including an upstream braking bridle formed by the rolls 1', 2' which are braked and bridles 3', 4' which are driven. The bridles 5', 6' and 7', 8' have rolls which are driven at a greater speed than the rolls 3', 4' to establish a first stretching zone $R_1$ between rolls 4' and 5'. The rolls 5' and 6' are driven with a stepped increase in speed as are the rolls 7', 8' so that at least one additional stretching zone $R_2$ is formed between the rolls 5' and 6'.

The bridle formed by rolls 7', 8' is driven at higher speed than the rolls 6' and the bridle formed by rolls 9', 10', driven at a higher speed than the rolls 7', 8'.

Thus the rolls 1'–10' define at least the prestretching zone $R_1$ and at least one stretching or after-stretching zone $R_2$.

Figure 2:
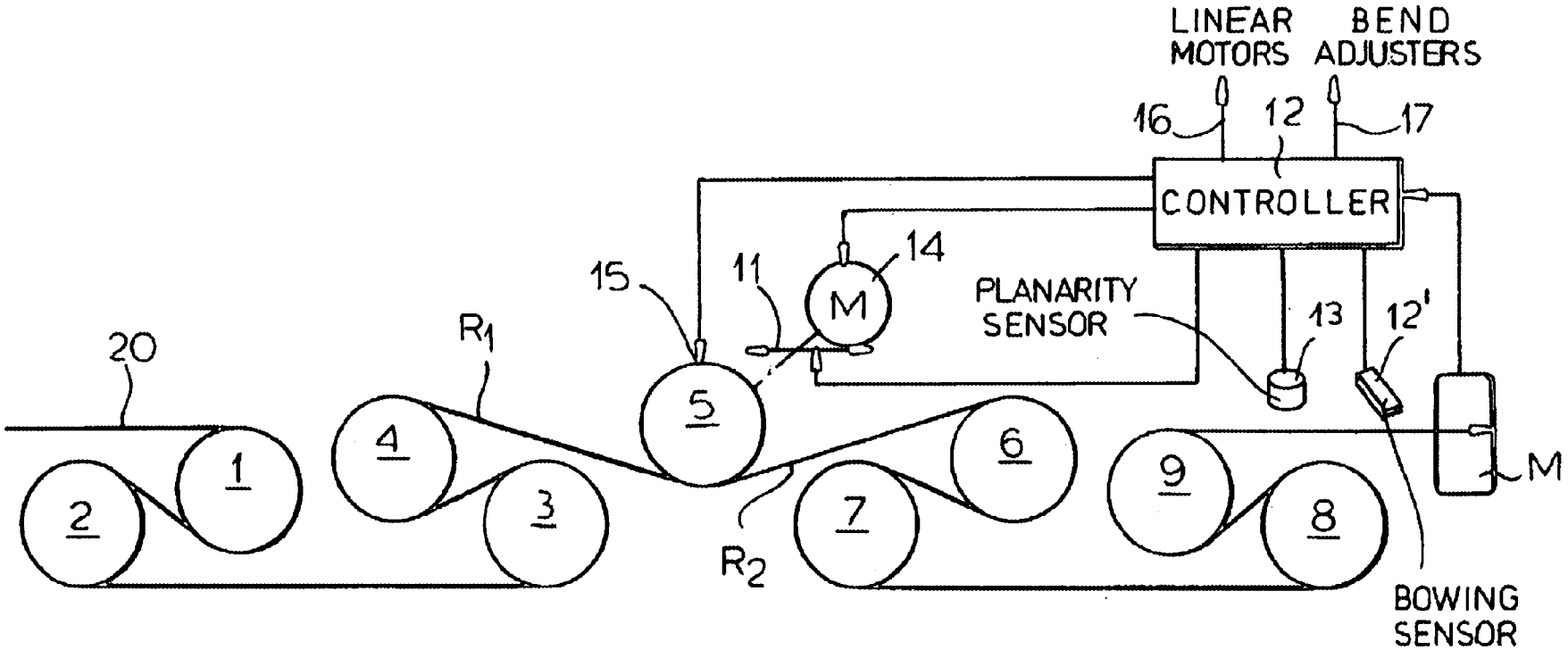
FIG. 2 is a diagram similar to FIG. 1 but illustrating a stretch leveler according to the invention.

In FIG. 2, however, a braking set of rolls 1, 2, 3, 4 is provided on one side of a driven roll 5 while a traction set of rolls 6, 7, 8, 9 is provided on the other side of the driven roll 5 so that the stretching zones $R_1$ and $R_2$ are formed. The roll 5 can be adjusted as represented by the arrow 11 from the controller 12 to vary the relative lengths of the zones $R_1$ and $R_2$ and a crossbow sensor can be provided at M in conjunction with other sensors including the bowing sensor 12' and the planarity sensor 13 to provide inputs to the controller 12. The controller 12 has outputs to the motor 14 driving the roll 5 and to an effector 15 which controls the arc around which the strip 20 is in contact with the roll 5. Additional outputs may be provided to a linear motor 16 generating an electromagnetic field across the strip and thereby across its width. Another output of the controller 12 may be provided at 17 for the bend adjusters.

Figure 6:
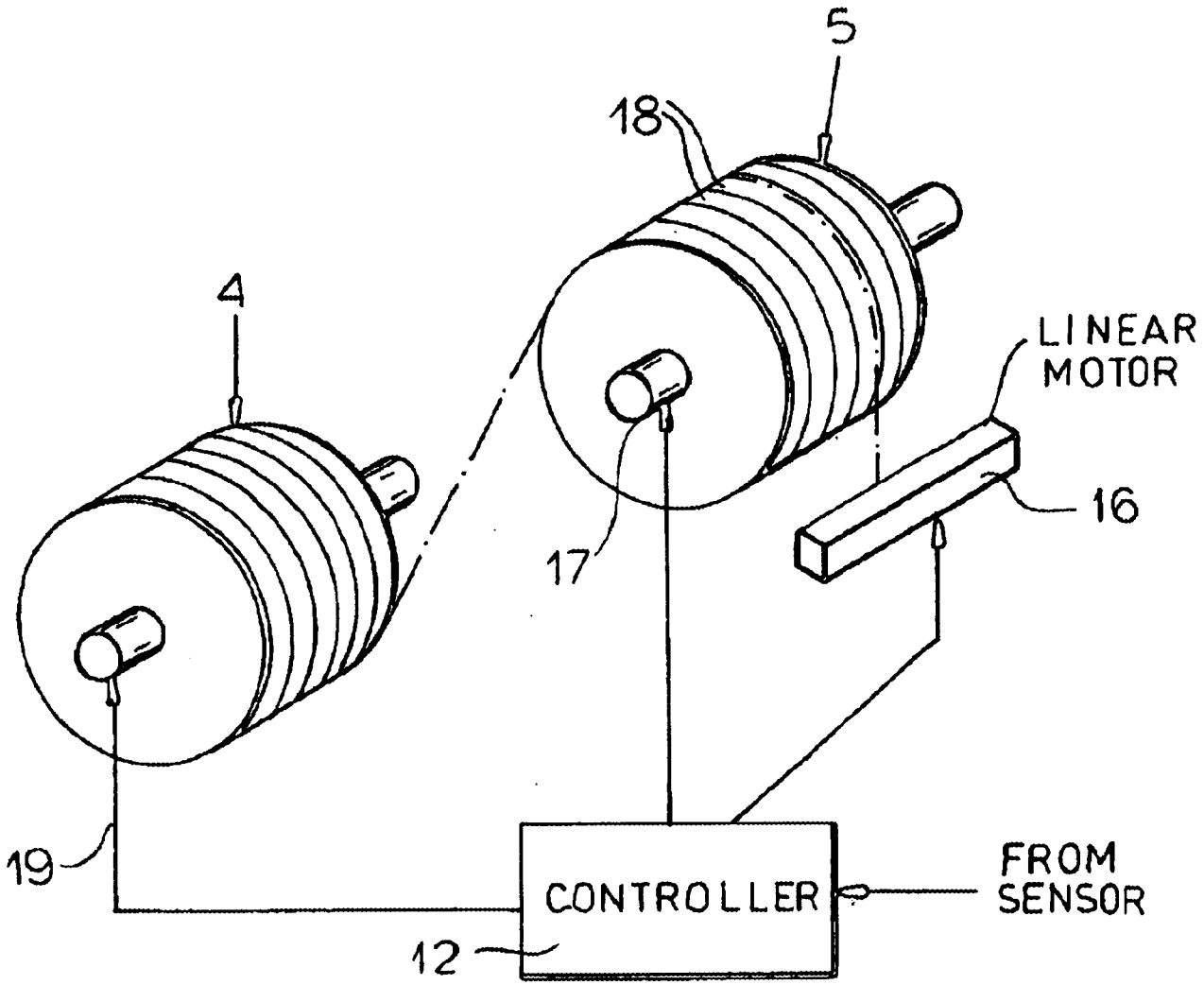
FIG. 6 is a diagram showing additional features of the apparatus of the invention.

As can be seen from FIG. 6, the driven roll 5 may have zones 18 across its width which may impart a bulging or concave configuration to the roll as controlled by the input 17 previously mentioned. Similarly the roll 4 or 6 may have zones which are controlled by an output 19 from the controller to alter the configuration from convex to concave across the width.

Figure 3:
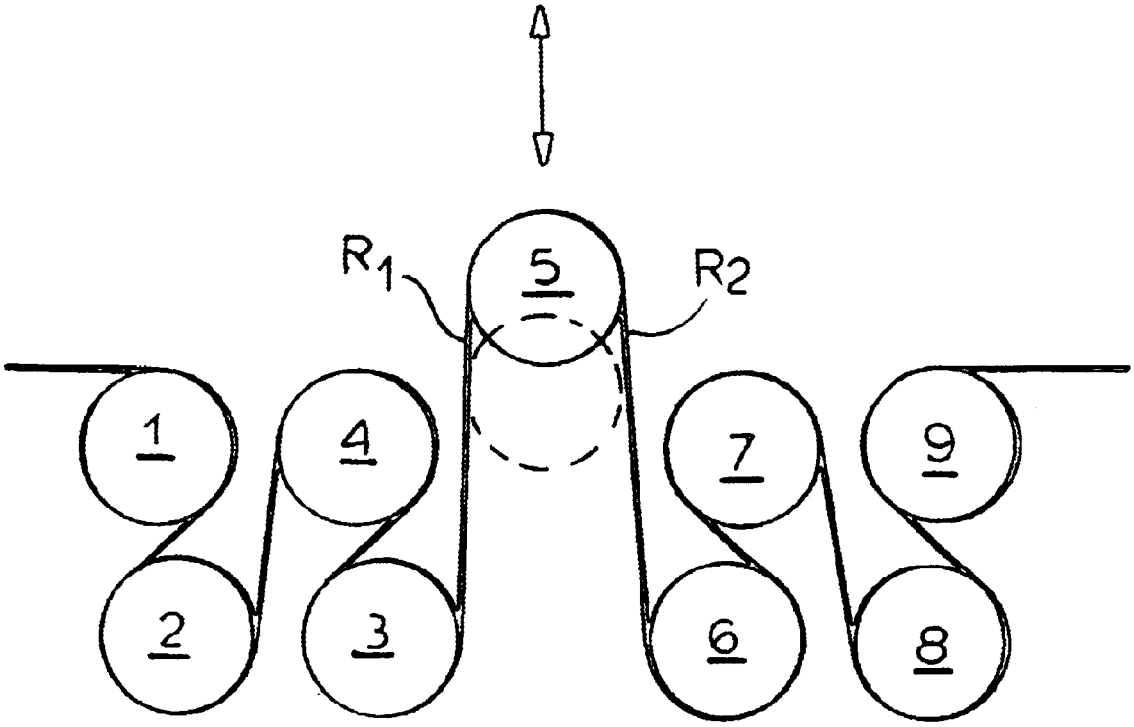
FIG. 3 is a diagram of yet another stretch leveler according to the invention.

FIG. 3 shows an embodiment in which the bridles forming the braking and traction sets are oriented in horizontal planes. Here the vertical displacement of the driven roll 5 controls the lengths of the stretch zones $R_1$ and $R_2$.

Figure 4:
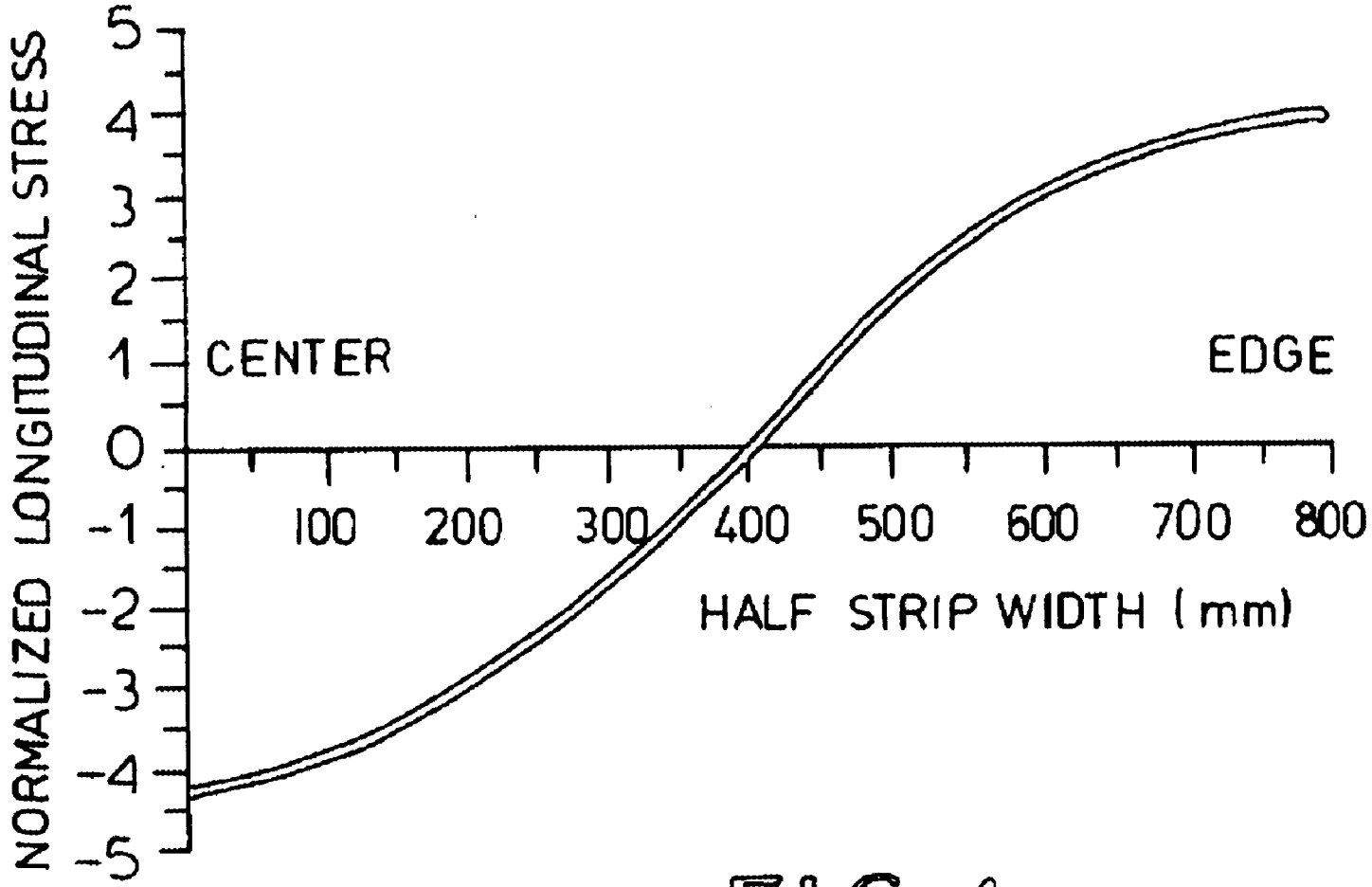
FIGS. 4 and 5 are graphs illustrating the invention.
Figure 5:
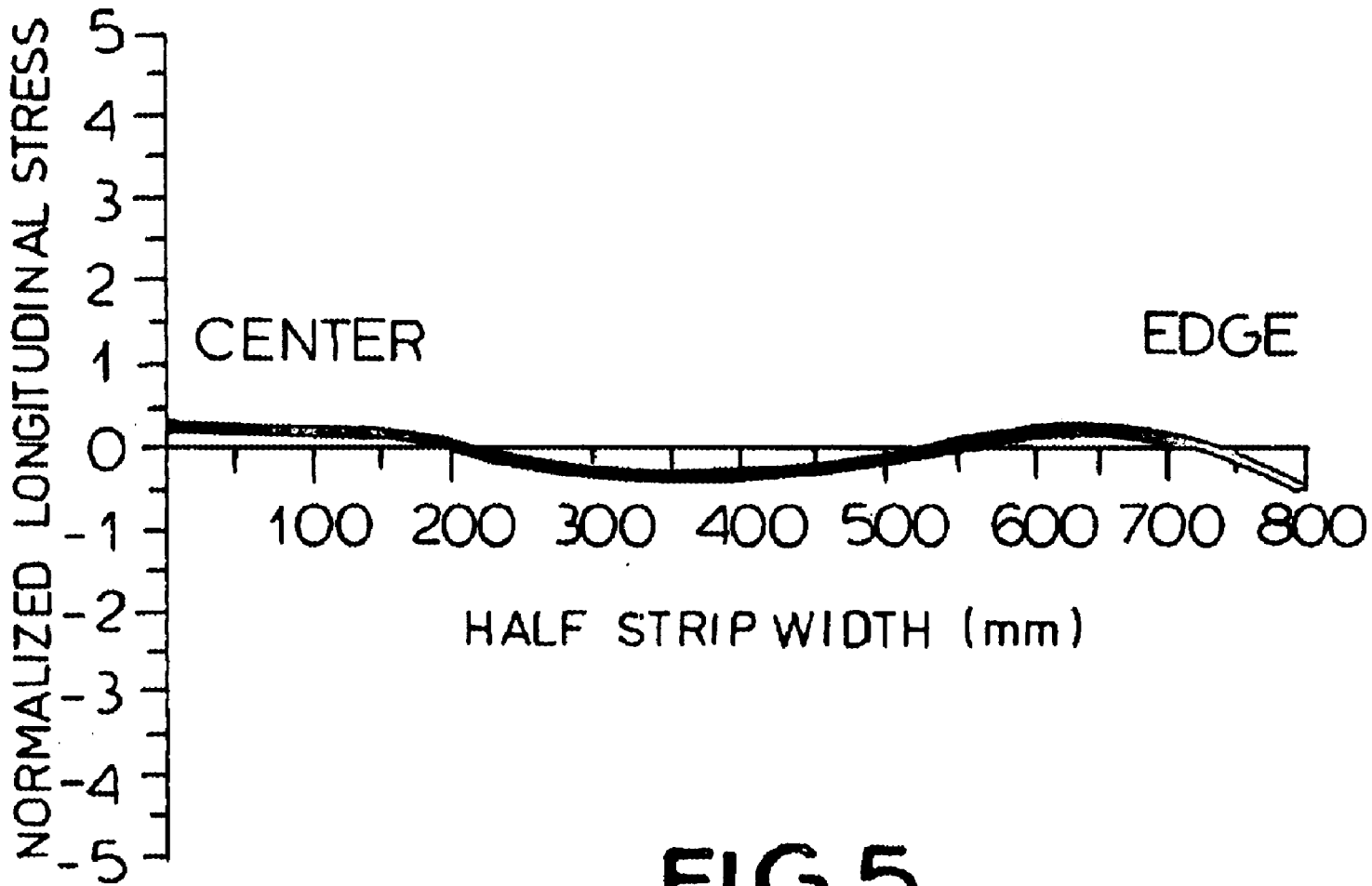

FIG. 4 shows the result of a first example in a graph in which the normalized longitudinal stress is plotted against the half strip width. FIG. 5 shows the corresponding result of an example 2. In both examples it is assumed that prior to the stretching process the strip is ideally planar. As can be seen from the graphs, the stretching process itself may produce nonuniform stresses across the strip width. In example 1 (FIG. 4), there is a stress difference of 8 MPa, corresponding to 13 J-units of difference in the plastic longitudinal elongation between the center of the strip and the edge. The strip, after stretching, is slightly corrugated.

In example 1, the strip is stretched in a single stretching zone of a length of 900 mm, corresponding substantially to 0.56 times the strip width. In example 2 (FIG. 5), the strip is stretched in two stretching zones, namely, a first zone and a second zone each of a length of 2,000 mm, corresponding to 1.25 times the strip width (FIG. 2). Here the stress difference after stretching amounted only to 1 MPa between the center and the edge, corresponding to about 1 J unit. The strip is thus approximately planar.

The effect is also similar to that which is achieved in leveling of strip which has a crossbow or coil set. The length of the stretching zones should each be greater than 0.56 $b_{max}$ (where $b_{max}$ is the maximum strip width). Still better results are obtained with stretching zone lengths which are 1 b to 1.5 b where b is the actual strip width (see FIG. 3). In FIG. 3 the stretching zone length can be adjusted by displacement of the roll 5. A typical strip width range is 600 to 1850 mm.

If the strip is stretched only in the zone between the rolls 4 and 5, a longitudinal residual curvature or coil set remains in the direction of the bending effected at the roll 5. If the strip is stretched only in the zone between the roll 5 and roll 6, a coil P remains in the strip in the direction in which bending was effected by roll 5. Where the strip is stretched in both zones around the roll 5, an appropriate ratio of the stretch for the two zones can reduce the coil set to zero. This is achieved according to the invention by controlling the bending about the roll 5 with respect to the bending at roll 6.

Since the coil set of the strip under tension, based upon the Poisson effect can be observed as transverse curvature or in-line crossbow, it can be optically measured by the sensors and eliminated by the control circuit.

The system of FIG. 2 thus affords by comparison to the prior art system of FIG. 1, a simplification of the structure (at least one roll fewer) and an improvement in leveling. The arc around which the strip is slung at the roll 5 should only be sufficient to enable the roll 5 to bring about a 1 to 10% increase in strip tension without slip.

In general, the stretching zones should not be excessive so that the degree of stretch will not vary materially from an average value along that zone. Because of thickness and strength fluctuations in the strip over the strip length, when the strip zone is excessive, local differences in the degree of stretch can arise.

We claim:

1. A stretch leveler for metal strip having a thickness range of substantially 0.1 to 4 mm between a minimum thickness and a maximum thickness and a strip width range between a minimum width and a maximum width, said stretch leveler comprising:

a brake roll set having a plurality of brake rolls around which a traveling metal workpiece strip passes for exerting a drag upon said traveling metal workpiece strip;

a traction roll set spaced from said brake roll set and having a plurality of traction rolls around which said traveling metal workpiece strip passes for exerting traction upon said traveling metal workpiece strip; and a single driven roll engaging said traveling metal workpiece strip at a location between said brake roll set and said traction roll set and defining a first leveling stretching zone between said brake roll set and said driven roll and a second leveling stretching zone between said driven roll and said traction roll set such that each of said zones has a length which is at least 0.5 times said maximum strip width, said strip being partially looped around said single driven roll at said location.

2. The stretch leveler defined in claim 1 wherein at least one of said lengths has a maximum of ten times the maximum width of the strip.

3. The stretch leveler defined in claim 1 wherein the lengths of the first and second zones is one to two times the maximum strip width.

4. The stretch leveler defined in claim 1 wherein a last roll of said brake roll set and a first roll of said traction roll set, in a direction of displacement of said workpiece strip and said driven roll have diameters which are at least 1,000 times the maximum thickness.

5. The stretch leveler defined in claim 1 wherein at least one of the last rolls of said brake roll set, said driven roll and a first roll of said traction roll set in a direction of displacement of said workpiece strip has an adjustable concave/convex contour.

6. The stretch leveler defined in claim 5, further comprising means for adjusting said contour zonewise across a width of said workpiece strip.

7. A stretch leveler for metal strip having a thickness range of substantially 0.1 to 4 mm between a minimum thickness and a maximum thickness and a strip width range between a minimum width and a maximum width, said stretch leveler comprising:

a brake roll set having a plurality of brake rolls around which a traveling metal workpiece strip passes for exerting a drag upon said traveling metal workpiece strip;

a traction roll set spaced from said brake roll set and having a plurality of traction rolls around which said traveling metal workpiece strip passes for exerting traction upon said traveling metal workpiece strip;

a driven roll engaging said traveling metal workpiece strip between said brake roll set and said traction roll set and defining a first leveling stretching zone between said brake roll set and said driven roll and a second leveling stretching zone between said driven roll and said traction roll set such that each of said zones has a length which is at least 0.5 times said maximum strip width; and a linear motor for varying strip tension distribution over the width of the workpiece strip.

8. The stretch leveler defined in claim 1 wherein said driven roll and a first roll of said traction roll set have opposite strip-bending directions and residual longitudinal and transverse curvature in the strip subsequent to stretching is adjusted by varying a ratio of stretch in said zones.

9. A stretch leveler for metal strip having a thickness range of substantially 0.1 to 4 mm between a minimum thickness and a maximum thickness and a strip width range between a minimum width and a maximum width, said stretch leveler comprising:

a brake roll set having a plurality of brake rolls around which a traveling metal workpiece strip passes for exerting a drag upon said traveling metal workpiece strip;

a traction roll set spaced from said brake roll set and having a plurality of traction rolls around which said traveling metal workpiece strip passes for exerting traction upon said traveling metal workpiece strip;

a driven roll engaging said traveling metal workpiece strip between said brake roll set and said traction roll set and defining a first leveling stretching zone between said brake roll set and said driven roll and a second leveling stretching zone between said driven roll and said traction roll set such that each of said zones has a length which is at least 0.5 times said maximum strip width; and means for measuring an in-line crossbow of the workpiece strip and controlling correction of strip curvature with the measured crossbow.

10. A stretch leveler for metal strip having a thickness range of substantially 0.1 to 4 mm between a minimum thickness and a maximum thickness and a strip width range between a minimum width and a maximum width, said stretch leveler comprising:

a brake roll set having a plurality of brake rolls around which a traveling metal workpiece strip passes for exerting a drag upon said traveling metal workpiece strip;

a traction roll set spaced from said brake roll set and having a plurality of traction rolls around which said traveling metal workpiece strip passes for exerting traction upon said traveling metal workpiece strip;

a driven roll engaging said traveling metal workpiece strip between said brake roll set and said traction roll set and defining a first leveling stretching zone between said brake roll set and said driven roll and a second leveling stretching zone between said driven roll and said traction roll set such that each of said zones has a length which is at least 0.5 times said maximum strip width said strip being partially looped around said single driven roll at said location; and means for measuring planarity of the workpiece strip in line and controlling the stretching of said strip in response to the planarity measurement.

11. The stretch leveler defined in claim 1 wherein said strip passes around said driven roll through an arc which is at most equal to 180° of the circumference thereof.

12. The stretch leveler defined in claim 11 wherein said arc is at most equal to 90° of the circumference thereof.

13. A stretch leveler for metal strip having a thickness range of substantially 0.1 to 4 mm between a minimum thickness and a maximum thickness and a strip width range between a minimum width and a maximum width, said stretch leveler comprising:

a brake roll set having a plurality of brake rolls around which a traveling metal workpiece strip passes for exerting a drag upon said traveling metal workpiece strip;

a traction roll set spaced from said brake roll set and having a plurality of traction rolls around which said traveling metal workpiece strip passes for exerting traction upon said traveling metal workpiece strip;

a driven roll engaging said traveling metal workpiece strip between said brake roll set and said traction roll set and defining a first leveling stretching zone between said brake roll set and said driven roll and a second leveling stretching zone between said driven roll and said traction roll set such that each of said zones has a length which is at least 0.5 times said maximum strip width; and means for varying said lengths to enable optimal lengths of said zone to be selected for a corresponding width of the workpiece stretch.

* * * * *